United States Patent [19]

Rice

[11] 4,348,124

[45] Sep. 7, 1982

[54] TABULATION RACK WITH SPRING PIN HOLDING

[75] Inventor: Larry J. Rice, Lexington, Ky.

[73] Assignee: International Business Machines Corporation, Armonk, N.Y.

[21] Appl. No.: 163,677

[22] Filed: Jun. 27, 1980

[51] Int. Cl.[3] ..... B41J 21/04

[52] U.S. Cl. ..... 400/298; 400/293; 400/295.1

[58] Field of Search ..... 400/293, 295, 295.1, 400/295.2, 297, 298

[56] References Cited

U.S. PATENT DOCUMENTS

| | | | |
|---|---|---|---|
| 1,043,262 | 11/1912 | Smith | 400/295.1 |
| 2,312,676 | 3/1943 | Schremp | 400/298 |
| 2,317,183 | 4/1943 | Dobson | 400/298 |
| 2,852,120 | 9/1958 | Braun et al. | 400/298 |
| 3,279,577 | 10/1966 | Menicanti | 400/298 X |
| 3,333,669 | 8/1967 | Schaefer | 400/297 |
| 3,428,159 | 2/1969 | Klingner et al. | 400/292 |
| 3,540,565 | 11/1970 | Hanft et al. | 400/298 X |
| 3,858,706 | 1/1975 | Gottsmann | 400/297 X |
| 3,871,508 | 3/1975 | Petersson | 400/298 X |
| 4,134,694 | 1/1979 | Stuiber et al. | 400/298 X |

FOREIGN PATENT DOCUMENTS

| | | | |
|---|---|---|---|
| 745564 | 3/1944 | Fed. Rep. of Germany | 400/297 |
| 689053 | 4/1965 | Italy | 400/295 |
| 307957 | 1/1969 | Sweden | 400/298 |
| 1026958 | 4/1966 | United Kingdom . | |

OTHER PUBLICATIONS

IBM Technical Disclosure Bulletin, "Dual-Pitch Tab Rack", Kruspe, vol. 8, No. 5, Oct. 1965, p. 793.

*Primary Examiner*—Ernest T. Wright, Jr.
*Attorney, Agent, or Firm*—John A. Brady

[57] ABSTRACT

A tabulation rack having simple and inexpensive construction. The rack has a set of straight-sided pins (5 or 50) which act as stops. They are held by an elongated main beam (3 or 54) in opposed slots. In one embodiment a pair of coil springs (7) are deformed along their long axis within the area formed by the bridge (25) of beam (3) and the pins (5). In a second embodiment, a single music wire 52 is extended between staggered, round pins 50. Frictional drag holds the pins (5 or 50) in their set and clear positions.

4 Claims, 13 Drawing Figures

TABULATION RACK WITH SPRING PIN HOLDING

CROSS-REFERENCE TO RELATED APPLICATION

Application Ser. No. 163,676 filed June 27, 1980, the same date herewith, and bearing the same title as this application has Clinton E. Abbott and Larry Joe Rice as joint inventors. That is the same Larry Joe Rice who is the sole inventor on this application. That application claims the embodiment with a single, straight spring, shown in FIGS. 9, 10 and 11 of this application, as an improvement invention over the subject matter described and claimed, both specifically and generically, in this application.

TECHNICAL FIELD

This invention relates to tabulation racks for printers which step to printing locations, particularly typewriters. More specifically, this invention relates to a low cost and practical tabulation rack assembly particularly well suited for a compact typewriter.

Intricate designs for such a tabulation rack generally entail expense in manufacture and maintenance and increased size and weight. Use of such intricate design is unduly costly and may be entirely impractical where the desired product is a small typewriter or printer.

BACKGROUND ART

Tabulation racks for use in a tabulation operation are well known in the typewriter and related arts. The tabulation mechanisms permit the machine operator to quickly position printing means relative to paper at a predetermined point on the writing line by depressing a "tab" keybutton. Movement is initiated by the keybutton, and the movement usually is terminated in response to the movement carrying a member into contact with a stop located properly on a tabulation rack. This is used in typing columns of figures, indenting paragraphs, and any other operation that requires positioning the printing means to a specific point each time.

In many typewriters the tabulator stop member terminates tabulation by physically blocking and absorbing the momentum of a moving carriage. In other machines, the tabulator stop member merely positions controlling members which stop movement without substantial impact on the tabulator stop member. This invention is designed for use in a tabulation system in which the tabulation stops do not absorb large amounts of kinetic energy.

This invention employs a spring to provide enough frictional drag to hold simply shaped pins or stops in their set and clear position. Prior art is known showing springs in tabulation racks, specifically: German Pat. No. 745,564 issued in 1944 to Heinrich Kleyer AG, and U.S. Pat. Nos. 2,852,120 to Braun et al and 2,312,676 to Schremp. These patents involve shaped surfaces on the stops to provide positive detenting action. Simple frictional drag is not an essential or inherent part of the functions disclosed.

Accordingly, the three foregoing patents are believed to be of little real significance to the patentability of this invention. No prior art is known in which a tabulation rack or the like employs simple pins having straight surfaces with the pins held at different settings by friction from contact of the straight surfaces with a receiving hole, with sufficient frictional drag created by force from a biased spring or resilient member. U.S. Pat. No. 3,333,669 to Schaefer does employ such friction positioning in a tabulation rack, but the drag force is created by the resilience of the stop members, which are twisted.

DISCLOSURE OF THE INVENTION

It is, accordingly, an object of this invention to provide a tabulation rack having simple and inexpensive construction.

It is also an object of this invention to provide a tabulation rack suited for use in a compact typewriter or other stepping printer.

In accordance with this invention the tabulation stops are simple shapes having generally straight, major surfaces. The straight surface can be, for example, the long dimension of a cylinder or one of the sides of a solid which appears as a rectangle when viewed perpendicular to that side. The stops may be easily produced by simple stamping or cutting operations. Similarly, the supporting beam or bracket of the tab rack comprises three sides joined at 90° angles with opposing sides having a series of opposing holes. The holes can be stamped out of a blank and the blank then bent into the three-sided configuration.

The pins are readily inserted in the holes since the fit is loose. Frictional drag is created by a spring which extends as a unit throughout the length of the rack. In a specific design, a single coil spring deformed by being squeezed in the pocket between the pins and the bridging side may not bias every pin sufficiently when the pins are quite close together. Two springs side-by-side do provide fully consistent results. In another specific design, a single spring wire, wound in a serpentine manner across a plurality of round stop pins, is fully sufficient to hold the pins in their set and clear positions.

BRIEF DESCRIPTION OF THE DRAWING

The details of this invention will be described in connectin with the accompanying figures in which.

BEST MODE FOR CARRYING OUT THE INVENTION

Coiled Spring Embodiment

Figure 1:
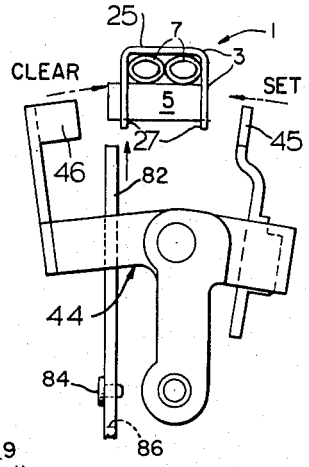
FIG. 1 is an end view of the subject tabulation rack shown partially in its operating environment.

FIG. 1 shows the tabulation rack 1 assembled and partially in its operating environment. Rack 1 can be considered to have three major elements: the main bracket or beam 3, which may be as long as necessary to encompass all tabulation positions in a particular typewriter; the stops, which are pins 5; and the resilient, biasing members, springs 7. In the application presently preferred for this tabulation rack 1, the typewriter has a paper carriage 72 (FIG. 12) which moves past a printing station step-by-step during printing as is entirely conventional.

Figure 3:
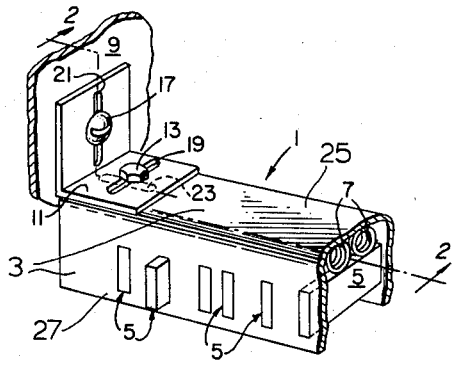
FIG. 3 is a perspective view showing the end of the tabulation rack and its mounting to the carriage frame.
Figure 2:
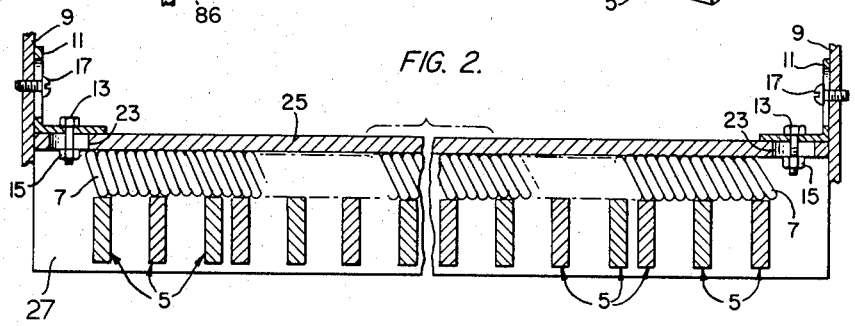
FIG. 2 is a side view of the tabulation rack sectioned on line 2—2 shown in FIG. 3.

Referring to FIGS. 2 and 3, the beam or bracket 3 is seen to be mounted to vertical portions 9 of the carriage 72 (FIG. 12) by attachment through an L shaped bracket 11. The shorter leg of bracket 11 is mounted on top of beam 3 through a bolt 13 and meshing nut 15, which is on the bottom. The longer leg of bracket 11 is mounted against a thin vertical portion 9 which is threaded to receive and hold screw 17.

FIG. 3 presents a perspective view which illustrates the structures by which pin adjustments of the mounted position of rack 1 are made. The short leg of bracket 11 has a slot 19 just wide enough to receive bolt 13, but elongated across the width of the leg. The slot 19 terminates near each side of the leg of bracket 11. Similarly, the long leg of bracket 11 has a slot 21, just wide enough to receive screw 17, but elongated up the length of the leg. Shown in dotted outline, as it is hidden by the short leg of bracket 11, is a elongated slot 23 in the upper section or bridge 25 of beam 3. Slot 23 is just wide enough to receive bolt 13, but wide enough to permit bolt 13 to be positioned at positions varying 2 millimeters longitudinally along the length of rack 1.

It will be apparent from this structure that the slots 19, 21, and 23 provide adjustment vertically and horizontally, both down the direction of the length of rack 1 and at 90° to that, which is toward the front and back of the typewriter. The nut 15 and the screw 17 are loosened to make adjustment along the corresponding slot 19, 21 or 23. When the position is accomplished by changing the positions within one or more of the slots 19, 21 and 23, the nut 15 and screw 17 are tightened and left tightened. This adjustable mounting forms no part of the new tabulation rack 1 for which patent coverage is herein sought, but is described so that the invention can be better understood and appreciated.

Figure 4:
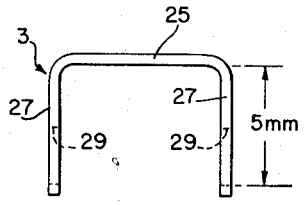
FIG. 4 is an end view of the main beam or bracket of the tabulation rack.

Bracket 3 of the rack 1 is stamped from soft, cold rolled steel, specifically from a sheet one-half millimeter in thickness. Bracket 3 alone, in a view looking down its long dimension, is shown in FIG. 4. Slots 29, being internal, are shown by dotted outline. Although stamped from a single piece, bracket 3 has a bridge 25 joining opposing sides 27 at 90° angles; sides 27 have opposing slots 29, which are holes entirely through the sides 27. Slots 29 are elongated in the direction away from bridge 25 to accommodate pins 5 as will be further discussed.

The small sizes realized in accordance with this invention should be appreciated. The inside dimension between sides 27 is 7 millimeters. The length of sides 27 from top to end is 5.84 millimeters. The shortest distance from the underside of bridge 25 to farthest end of a slot 29 is 5 millimeters.

Figure 5:
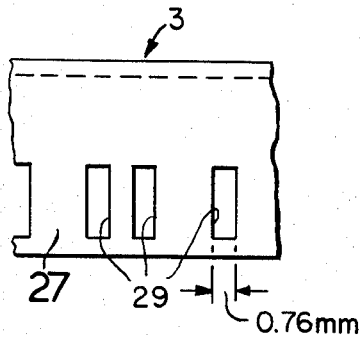
FIG. 5 is a side view of an intermediate part of the main beam or bracket of the tabulation rack.

FIG. 5 is a side view of an intermediate part of bracket 3, illustrating more clearly the slots 29. The slots 29 have regular, straight sides and are rectangular in cross section. The long dimension, which extends away from the bridge 25, is about 2.5 millimeters. The width is about 0.76 millimeters.

It will be understood that slots 29 are in pairs directly opposed on opposite sides 27 of bracket 3 so that a pin 5 can be inserted through the pair of slots 29 and thereby be supported on two sides by the sides of the slots 29 in which it is inserted.

Figure 6:
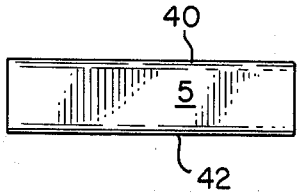
FIG. 6 is a side view of one of the pins which function as tabulation stops.
Figure 7:
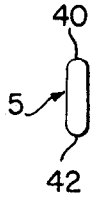
FIG. 7 is an end view of one of the pins which function as tabulation stops.

A pin 5 is illustrated by side view in FIG. 6 and by end view in FIG. 7. Although gently rounded at its top 40 and bottom 42, its major dimensions are straight rather than curved. Of particular interest is the straight bottom surface 42, which appears as one of the sides of a rectangle when viewed from the side, as in FIG. 6. Surface 42 is a straight surface which rides against the bottom of slots 29. Since surface 42 is straight, any significant resistance to movement laterally from set and clear positions will be by simple frictional drag. The pins 5 are 10 millimeters in major length, 2 millimeters high, and 0.7 millimeters thick. They are thereby designed to enter slots 29 with a loose fit.

The two coil springs 7 fit side-by-side in the area between bridge 25 and pins 5 and extend along the entire length of rack 1 where pins 5 are situated, so that each spring 7 contacts all of the pins 5. The springs 7 are of 0.3 millimeter diameter mechanical spring wire. The outside diameter of each spring 7 is 3.4–0.1 millimeters and the initial tension is 0.231 Newton.

Reference is made again to FIG. 1 to illustrate the selection of the pins 5 as tabulation stops. The set and clear mechanism 44 is essentially conventional and is shown only illustratively as it forms no part of this invention. Each pin 5 may be brought opposite the abutments 45 and 46 of the mechanism 44 by relative movement of the bracket 3 with respect to mechanism 44. When mechanism 44 is rotated in the set direction, as shown in FIG. 1, the abutment 45 is moved leftward to engage the end of a pin 5 and move that pin 5 by direct force down its length until that end of the pin 5 is substantially flush with the outside of the right side 27 of bracket 3.

Figure 8:
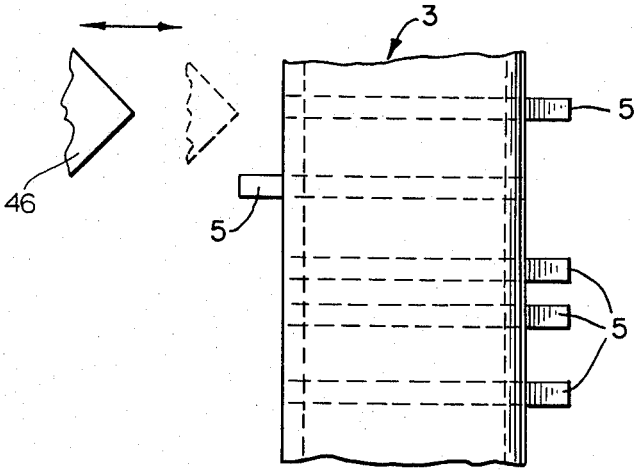
FIG. 8 is a view from the top of an intermediate portion of the tabulation rack.

In a clearing operation mechanism 44 is rotated the opposite direction after the pin 5 to be cleared is brought to the position at which the mechanism 44 is located. Abutment 46 pushes the pin 5 in the same manner until its end is substantially flush with the outside of the other side 27 of bracket 3. FIG. 8 shows an intermediate portion of a rack 1 having various pins 5 in the set and clear position.

THE DUAL SPRING

Figure 13:
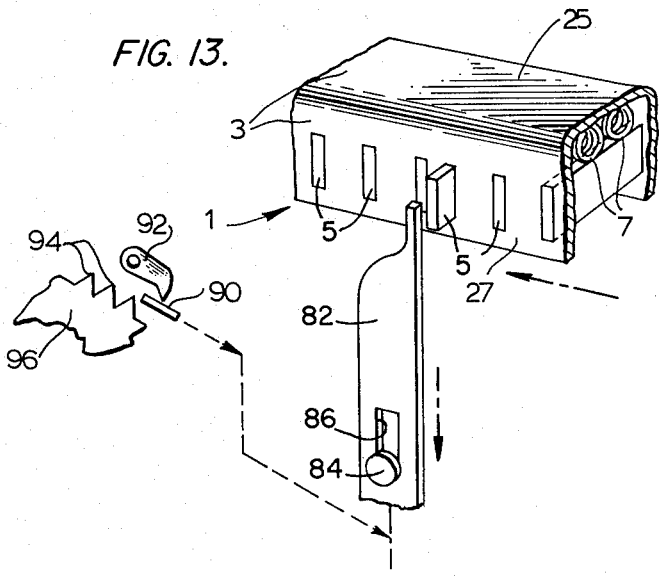
FIG. 13 illustrates the tabulation rack as a pin is about to engage the tabulation stop lever.

As is entirely conventional, a different pin 5 must be present to locate each different stop location. The embodiments here illustrated are a standard dual pitch or universal configuration. As shown in FIG. 2, the stop pins 5 have three pins, with the second and third spaced 0.1 inch from the preceeding pin along the tab rack 1 followed by a fourth pin spaced 0.05 inch from the third pin, with the fourth pin followed by a fifth pin spaced 0.083 inch from the fourth pin. The last of six pins is spaced from the fifth also 0.083 inch, and the first pin of the next sequence of six pins is spaced 0.083 inch from this pin. This sequence of six stops 5 is repeated enough times to form a tabulation rack 1 of the length desired in the particular typewriter. As is well known for racks of the kind of rack 1, each stop 5 trips a lever 82 (FIG. 1 and FIG. 13), linked to mechanism 90 which causes a pawl 92 to fall between selected teeth 94 in an escapement pinion 96 or the like. The escapement pinion 96 will have teeth 94 spaced for 10 pitch typing or 12 pitch type, according to the mode in which the machine is operating. The repeating sequence of spaced pins 5 permits selection of areas between desired teeth 94 in either pitch, so it is operable for either.

The dual pitch dimensions were a factor in the specific design in that experimentation showed that the two pins 5 closest together in a dual pitch rack 1 were not invariably held by a single coil spring 7. Apparently, a single coil spring 7 deformed and placed generally as described with respect to FIGS. 1 and 2 interacts with a pin 5 such that its recovery force is diminished as against closely spaced pins 5. Thus, where only one coil spring 7 was used, occasional failures occurred, always with respect to the two pins 5 close together in the dual pitch rack 1.

Two coil springs 7, as described, of the same size, are provided, positioned side-by-side in the area between bridge 25, sides 27, and pins 5. With the use of two springs 7, none of the occasional failures described occur. This has been established through testing. Accordingly, where a dual pitch rack 1 is to be designed using a coil spring 7, the use of two springs 7 side-by-side should be understood as essential, absent other design changes.

MANUFACTURE

Naturally, it is desirable and generally within the state of present manufacturing arts to automate assembly of the tabulation rack 1 here disclosed. During assembly, the springs 7 must be depressed so as to be partially collapsed along their long center axis while a pin 5 is inserted through opposing holes 29. When the springs 7 are released in that area, their recovery force presses and holds the pin 5. The springs 7 are simply placed in the bracket 3 resting on bridge 25 and pushed in one direction along their center axis with a surface which fits within that area.

Both of the springs 7 are deformed in the same direction down their center axes. As shown in FIG. 2, this results in an acute angle between the coils of the springs 7 and the axis of springs 7. Should spring 7 be relaxed just completely rather than deformed, that angle would be substantially 90°.

Finally, the assembled tabulation rack 1 is sprayed by SAE 30 weight oil. In quantity production, it is expected that the rack 1 will be dipped into the oil, rather than sprayed.

SINGLE, STRAIGHT SPRING EMBODIMENT

Figure 9:
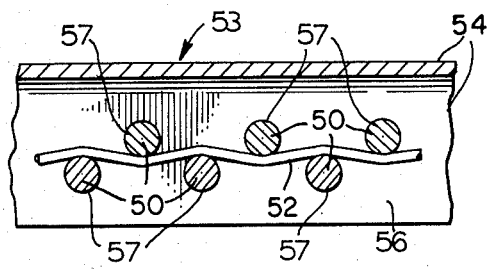
FIG. 9 is a side view sectioned on line 9—9 shown in FIG. 10 of an intermediate portion of the tabulation rack of the second embodiment.
Figure 10:
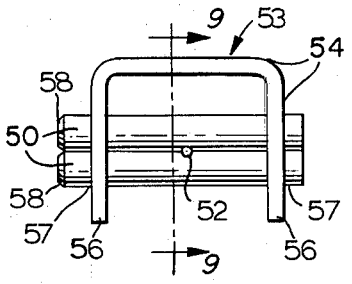
FIG. 10 is an end view of the bracket of the second embodiment.
Figure 11:
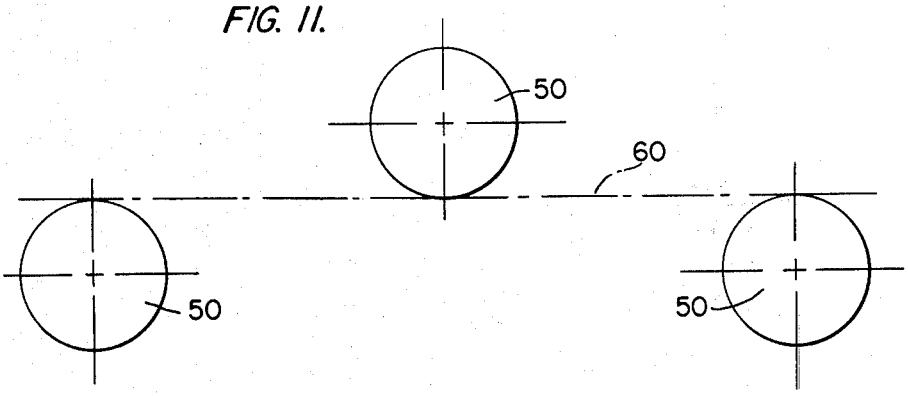
FIG. 11 is an illustration of the pin and wire positions of the second embodiment.

FIGS. 9, 10 and 11 illustrate an alternative embodiment of this invention in which the pins 50 are round and the resilient, biasing member 52 is a single, normally straight wire. FIG. 9 is a side view of an intermediate portion of the tabulation rack 53 in accordance with the embodiment, which is generally similar to the coil spring embodiment. The discussion and illustrations of functioning and associated structures made with respect to that embodiment, with reference to FIGS. 1 through 8, are equally applicable to this embodiment and will not be repeated.

As with the foregoing embodiment, the rack 53 can be considered to have three major elements: the main bracket or beam 54; the stops 50; and the biasing spring 52. The beam or bracket 54 is mounted in a typewriter as discussed with respect to FIGS. 2 and 3 for the other embodiment.

Bracket 54 is stamped from soft, cold rolled steel, specifically from a sheet one-half millimeter in thickness. The bracket 54 containing pins 50 is shown in FIG. 10 in a view looking down the long dimension of bracket 54. Bracket 54 has opposing sides 56 having opposing cylindrical holes 57 about 1.1 millimeter in diameter, which loosely receive a pin 50. The pins 50 are cylindrical, with the major dimension extending between opposing sides 56. This straight surface rides against the upper and lower sides of round, opposing holes 57 in sides 56, as will be discussed in more detail below.

The outer dimensions of this embodiment are the same as those of the first embodiment, illustrated in FIGS. 1 through 8. The pins 50 are one millimeter in diameter, being cut from a rod of 8620 steel, a very hard steel. As shown in FIG. 10, each pin 50 has straight, entirely flat face on the set side (right side in FIG. 10) and a chamfer 58 on the clear side. Chamfer 58 is a surface at 45° starting 0.3 millimeter from the end. One purpose of chamfer 58 is to assist in a continuous clearing of tab stops 50 by bringing a clear abutment 46 having a wedge shape (FIG. 8), into close contact with the rack 53 while the rack 53 is moved continuously. The details of such a continuous clearing operation form no part of this invention. The second purpose of chamfer 58 is to provide a somewhat reduced point to facilitate insertion of the pins 50 in the holes 57 of bracket 54 using that point as the leading part during the insertion.

In the center between sides 56 and engaging all of the pins 50 is a single length of round music wire 52 of about 0.010 inch diameter. The vertical positioning of the pins 50 is illustrated in FIG. 11. The locations are such that the top of one pin 50 is on the same plane, labeled 60, as the bottom of the pins 50 on either side. Thus, the top of every other pin 50 is located substantially on the same plane 60 as the bottom of the other pins 50. Wire 52 is deflected in up and down or serpentine configuration by the amount of its radius. Wire 52, being resilient spring material, produces a force toward assuming a straight line. This produces a force which forces the pins 50 above wire 52 upward, and the other pins 50, located below wire 52, downward.

The pins 50 remain in their set and clear position by simple frictional drag against lateral movement created by the force of the wire 52 attempting to assume a straight line.

MANUFACTURE

The primary advantages anticipated from this alternative embodiment are in manufacture. The staggered holes 57 permit wider spacing between the holes 57. Since the holes 57 will be punched, the increased separation provides a margin of safety against failures in the punching operation. Also, the round pins 50 may be more readily inserted in certain feeding techniques. The single, music wire spring 52 can be guided into place while the pins 50 are inserted, using automated equipment for quantity production.

Finally, the assembled tabulation rack 53 is sprayed by SAE 30 weight oil. In quantity production, it is expected that the rack 53 will be dipped into the oil, rather than sprayed.

TYPEWRITER WITH THE RACK

Figure 12:
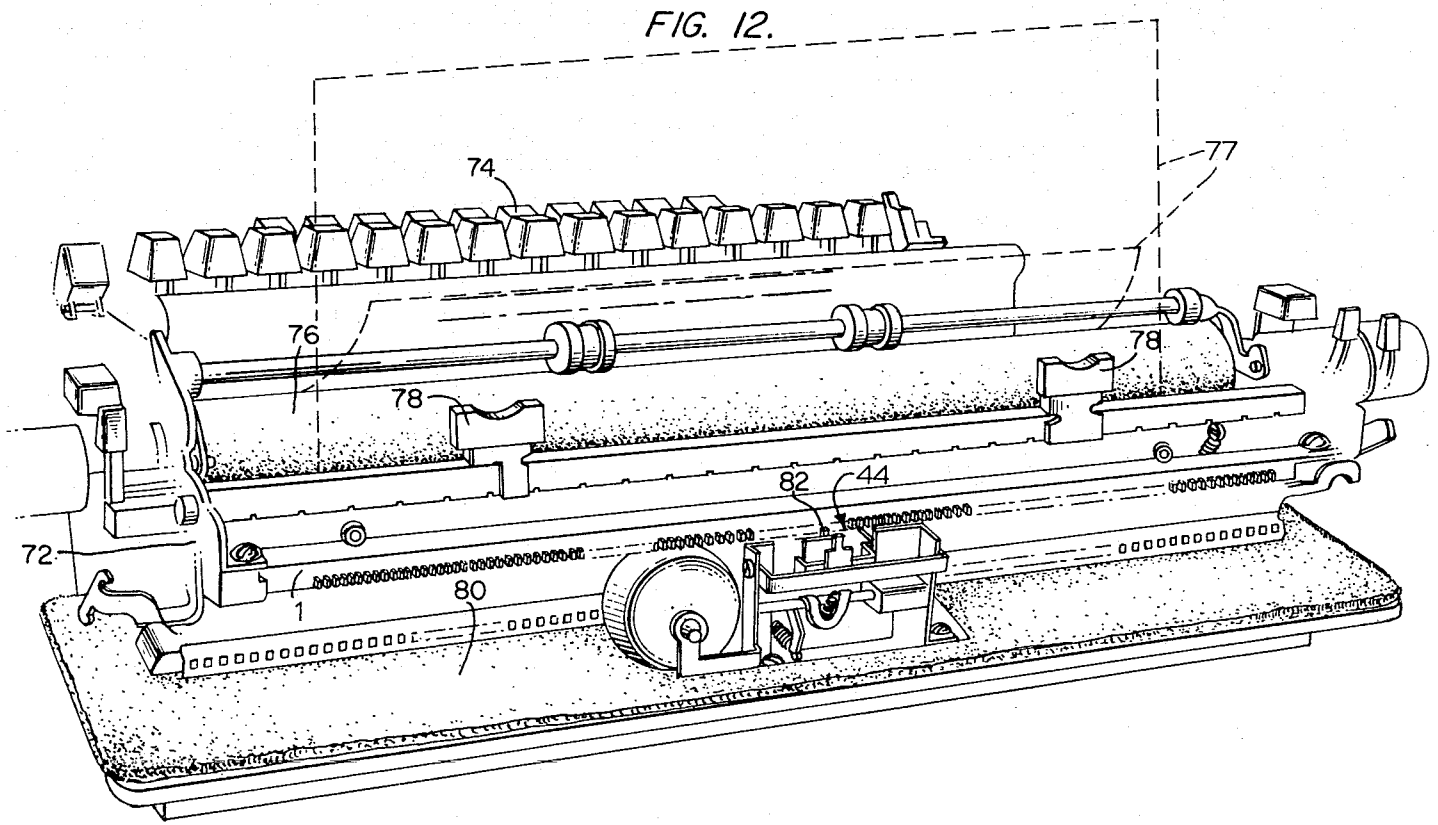
FIG. 12 generally illustrates the tabulation rack of this invention as part of a typewriter.

For the purposes of further clarifying the environment in which the subject tabulation racks 1 and 53 are employed, FIG. 12 shows a typewriter from the rear without a cover and with emphasis on the tabulation rack 1. The rack 1, shown mounted on a movable carriage 72, is a rack as described in the foregoing. The other typewriter structure may be generally conventional. In any event, the other typewriter structures form no part of this invention.

These structures include the keyboard 74, the platen 76, upon which paper 77 to receive typing is mounted, and margin controls 78. The printing structures, located between platen 76 and keyboard 74, are not shown.

In the particular embodiment presently preferred, the carriage 72 moves from left to right as viewed in FIG. 12 during typing, spacing, and tabulation. The set and clear mechanism 44, discussed in connection with FIG. 1, is mounted on the typewriter base 80 at the center of the typewriter.

Tabulation is initiated by a key operation, at which time the carriage 72, including rack 1, moves freely from left to right as viewed from the rear of the carriage 72. A tabulation-stop lever 82, normally located in front of the clear abutment 46 and below the pins 5 of the rack 1, is raised up to the plane of the pins 5. This is shown illustratively, but in some detail in FIGS. 1 and 13. It should be understood, of course, that this discussion of the stop lever 82 is equally applicable to the embodiment of FIGS. 9 through 11, as the tabulation-stop lever 82 and any subsequent mechanism actuated by the lever 82 form no part of this invention.

In FIG. 1 the stop lever 82 is shown in its position prior to tabulation, immediately in front of clear abutment 46 and with its top part under pins 5. The stop lever 82 is mounted on a pivot stud 84 in a vertical slot 86, the bottom of which is shown by dashed outline. During tabulation the lever 82 is shifted upward as indicated by the arrow in FIG. 1.

With lever 82 at the upper position, any pin 5 in the set position will engage lever 82 and pivot lever 82, clockwise as viewed in FIG. 12, around stud 84. That motion is linked to the mechanism 90 (FIG. 13) to cause a pawl 94 to fall between teeth 94 in escapement pinion 96 or the like, thereby stopping carriage motion and completing the tabulation. An intermediate part of a rack 1, with a pin 5 about to engage stop lever 82, is shown in FIG. 13, again illustratively only.

After tabulation, the carriage 72 is stopped and the operator may resume typing using keyboard 74.

It will be understood that modifications may be made in the preferred embodiment here described, some entirely obvious and others possibly entailing further invention, but all within the spirit and scope of this invention. Accordingly the coverage of this patent should not be limited to the specific structures disclosed, but should be as provided by law, with particular reference to the accompanying claims.

I claim:

1. A tabulation rack assembly for a typewriter or other stepping printer comprising:

a plurality of pins, each of said pins having a first, substantially straight outer surface on a first long side and a second, substantially straight outer surface on a second long side opposite said first long side, an elongated bracket having pairs of spaced, opposed holes for slidably supporting said pins positioned along said bracket at locations providing tabulation stops, said bracket having a continuous surface spaced away from said holes;

said pairs of holes in said bracket having received in them one of said pins with said first straight outer surface facing the side of said holes;

said holes being larger than the dimensions of the pin received so that the pin may move longitudinally to set and clear positions by sliding within the holes while remaining received within said pair of holes; and at least two continuous, resilient members extending in contact with a plurality of said pins received in said pairs of holes, said contact being with said second straight outer surface of each of said pins contacted, said resilient members being in a deformed configuration, said resilient members comprising two coil springs of mechanical spring wire deformed by the coils being partially pushed in one direction along the center axis of each said coil spring, the diameter of the coils being so large that said coils remain deformed in the area between said pins and said continuous surface of said bracket;

said resilience of said members in said deformed configuration being sufficient to press said first straight outer surfaces of all of said pins received in said pairs of holes against the side of said holes to create sufficient frictional drag to prevent movement of said pins during normal handling and use while permitting a direct pushing force to slide said pins to set and clear positions.

2. The tabulation rack assembly as in claim 1 in which said bracket in cross section viewed down the length of said bracket has a flat bridge and opposing sides positioned at substantially right angles to said bridge, said opposing sides having said opposed holes and said bridge being said continuous surface forming the area in which said coil springs are deformed.

3. The tabulation rack assembly as in claim 2 in which said holes are elongated in the direction said opposing sides extend away from said bridge, and said pins occupy said holes in a loose fit and are rectangular in cross section when viewed down the length of said bracket.

4. A tabulation rack assembly for a typewriter or other stepping printer comprising:

an elongated bracket supporting opposing sides, said sides having opposed holes positioned along said bracket at locations providing tabulation stops, said bracket having a continuous surface spaced away from said holes;

a plurality of pins, each located in one pair of said opposed holes, each pin fitting loosely within said pair of opposed holes and extending past said pair of opposed holes and permit said pins to slide while within said pair of opposed holes to set and clear positions; and two coil springs of mechanical spring wire extending in contact with each of said pins received in said opposed holes, deformed by the coils being partially pushed in one direction along the center axis of each said coil spring, the diameter of the coils being so large that said coils remain deformed in the area between said pins and said continuous surface of said bracket to provide a recovery force to press said pins against said holes, said pins in the area in which they contact said holes in the set position and the clear position presenting a first straight surface to the contacted side of the holes, said pins in the area in which said pins contact said coil springs presenting a second straight surface to the contacted part of said coil springs, said recovery force creating sufficient frictional drag to prevent movement of said pins during normal handling and use while permitting a direct pushing force to slide said pins to set and clear positions.

* * * * *